US011918868B2

(12) United States Patent
Franklin et al.

(10) Patent No.: US 11,918,868 B2
(45) **Date of Patent: *Mar. 5, 2024**

(54) GOLF CLUBS AND GOLF CLUB HEADS

(71) Applicant: KARSTEN MANUFACTURING CORPORATION, Phoenix, AZ (US)

(72) Inventors: David N. Franklin, Quintana Roo (MX); Jamil Jacaman, Forth Worth, TX (US)

(73) Assignee: Paul A. Jenny, Phoenix, AZ (US)

( * ) Notice: Subject to any disclaimer, the term of this patent is extended or adjusted under 35 U.S.C. 154(b) by 142 days.

This patent is subject to a terminal disclaimer.

(21) Appl. No.: 17/645,475

(22) Filed: Dec. 22, 2021

(65) Prior Publication Data

US 2022/0111269 A1 Apr. 14, 2022

Related U.S. Application Data

(63) Continuation of application No. 16/459,413, filed on Jul. 1, 2019, now Pat. No. 11,207,576, which is a continuation of application No. 15/849,511, filed on Dec. 20, 2017, now Pat. No. 10,335,655, which is a continuation of application No. 14/994,832, filed on Jan. 13, 2016, now Pat. No. 9,849,358.

(51) Int. Cl.
*A63B 53/04* (2015.01)

(52) U.S. Cl.
CPC ..... *A63B 53/0487* (2013.01); *A63B 53/0408* (2020.08); *A63B 53/0425* (2020.08); *A63B 53/0429* (2020.08); *A63B 53/0445* (2020.08); *A63B 2209/00* (2013.01)

(58) Field of Classification Search
CPC ..... A63B 53/0487; A63B 53/0425; A63B 53/0429; A63B 53/0445; A63B 53/065
See application file for complete search history.

(56) References Cited

U.S. PATENT DOCUMENTS

| | | | | |
|---|---|---|---|---|
| 5,358,249 | A * | 10/1994 | Mendralla | A63B 60/00 473/331 |
| 7,261,644 | B2 | 8/2007 | Burrows | |
| 7,717,801 | B2 | 5/2010 | Franklin et al. | |
| 7,806,779 | B2 | 10/2010 | Franklin | |
| 7,841,952 | B1 | 11/2010 | Oldknow | |
| 7,927,230 | B2 | 4/2011 | Solheim | |
| 8,012,035 | B2 | 9/2011 | Franklin et al. | |
| 8,083,605 | B2 | 12/2011 | Franklin et al. | |
| 8,083,611 | B2 | 12/2011 | Kuan et al. | |
| 8,216,081 | B2 | 7/2012 | Snyder et al. | |
| 8,337,320 | B2 | 12/2012 | Franklin et al. | |
| 8,425,342 | B2 * | 4/2013 | Snyder | A63B 60/54 473/331 |
| 8,622,850 | B2 | 1/2014 | Narita et al. | |

(Continued)

*Primary Examiner* — Michael D Dennis

(57) ABSTRACT

The invention is a golf club head with a ball striking face including a plurality of recesses, a plurality of first grooves, and a plurality of second grooves that extend between a heel edge and a toe edge of the club head. The ball striking face includes a first material, for example a metal material, and the plurality of recesses are filled with a fill material, for example a polymer material. The depth of the grooves, the height of the grooves, the fill material, and the positioning of the grooves can all affect the performance of the club head. In some embodiments, the club head is a putter-type club head.

20 Claims, 11 Drawing Sheets

(56) References Cited

U.S. PATENT DOCUMENTS

| | | | | |
|---|---|---|---|---|
| 8,641,549 | B2 | 2/2014 | Stites et al. | |
| 8,834,285 | B2 | 9/2014 | Franklin et al. | |
| 9,072,948 | B2 | 7/2015 | Franklin et al. | |
| 9,108,088 | B2 * | 8/2015 | Serrano | A63B 53/04 |
| 9,149,692 | B2 | 10/2015 | Shimahara | |
| 9,446,292 | B2 | 9/2016 | Stites et al. | |
| 9,855,477 | B2 | 1/2018 | Franklin et al. | |
| 9,901,792 | B2 | 2/2018 | Franklin et al. | |
| 9,956,463 | B2 | 5/2018 | Franklin et al. | |
| 2005/0020378 | A1 * | 1/2005 | Krumme | A63B 53/04 473/340 |
| 2010/0298062 | A1 * | 11/2010 | Oldknow | A63B 53/047 473/282 |
| 2012/0083353 | A1 * | 4/2012 | Franklin | A63B 53/0487 473/331 |
| 2016/0121178 | A1 | 5/2016 | Franklin et al. | |

* cited by examiner

GOLF CLUBS AND GOLF CLUB HEADS

RELATED APPLICATION DATA

This is a continuation of U.S. patent application Ser. No. 16/459,413, filed Jul. 1, 2019, which is a continuation of U.S. patent application Ser. No. 15/849,511, filed Dec. 20, 2017, now U.S. Pat. No. 10,335,655, which is a continuation of U.S. patent application Ser. No. 14/994,832, filed Jan. 13, 2016, now U.S. Pat. No. 9,849,358, the contents of which are incorporated herein by reference in their entirety.

FIELD OF THE INVENTION

This invention relates generally to golf clubs and golf club heads. Some aspects of this invention are well suited for putters and putter heads and/or irons and iron heads.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well-known golf superstars, at least in part, have increased golfs popularity in recent years both in the United States and across the world.

Golfers at all skill levels seek to improve their performance, lower their golf scores, and reach that next performance "level." Manufacturers of all types of golf equipment have responded to these demands, and the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement over the years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

While technological improvements to golf club designs have been made, additional improvements in golf clubs would be welcome in this field.

SUMMARY

The following presents a general summary of aspects of this invention in order to provide a basic understanding of the invention and various features of it. This summary is not intended to limit the scope of the invention in any way, but it simply provides a general overview and context for the more detailed description that follows.

According to aspects of this invention, a golf club head (e.g., a putter head, an iron head, etc.) includes a golf club head body having a ball striking face, a top, and a bottom, wherein an exposed ball striking surface at a top-to-bottom center line of the ball striking face includes a first material having a first hardness and a second material having a second hardness different from the first hardness. A top-to-bottom cross section of the exposed ball striking surface at the top-to-bottom center line of the ball striking face has a structure that includes a plurality of grooves including: (a) a first groove defining a first recess in the exposed ball striking surface, wherein, in the cross section, a first edge of the first groove constitutes the first material and a second edge of the first groove opposite the first edge constitutes the second material, and (b) a second groove defining a second recess in the exposed ball striking surface (e.g., closer to the top than the first groove), wherein, in the cross section, a first edge of the second groove constitutes the first material and a second edge of the second groove opposite the first edge of the second groove constitutes the first material. In other words, this example club head structure includes at least two different types of grooves.

In other examples of this invention, a golf club head body may include an exposed ball striking surface at a top-to-bottom center line of the ball striking face that has: (a) a top-most groove edge, (b) a bottom-most groove edge, and (c) a plurality of grooves defined in the ball striking face between the top-most groove edge and the bottom-most groove edge. The plurality of grooves may include: (A) a first subset of the plurality of grooves including grooves having a first edge formed from a first material of the ball striking face and a second edge opposite the first edge formed from a second material of the ball striking face, and wherein the first material is different from the second material and (B) a second subset of the plurality of grooves including grooves having a first edge formed from the first material and a second edge opposite the first edge also formed from the first material. Along the top-to-bottom center line of this example ball striking face from the top-most groove edge to the bottom-most groove edge, the exposed ball striking surface (e.g., the plane of the ball striking surface) may include: (a) at least 25% of the first material, (b) at least 20% of the second material, and (c) at least 35% open space corresponding to locations of the plurality of grooves (the first and second subsets of grooves).

BRIEF DESCRIPTION OF THE DRAWINGS

A more complete understanding of the present invention and certain advantages thereof may be acquired by referring to the following detailed description in consideration with the accompanying drawings, in which.

Figure 1A:
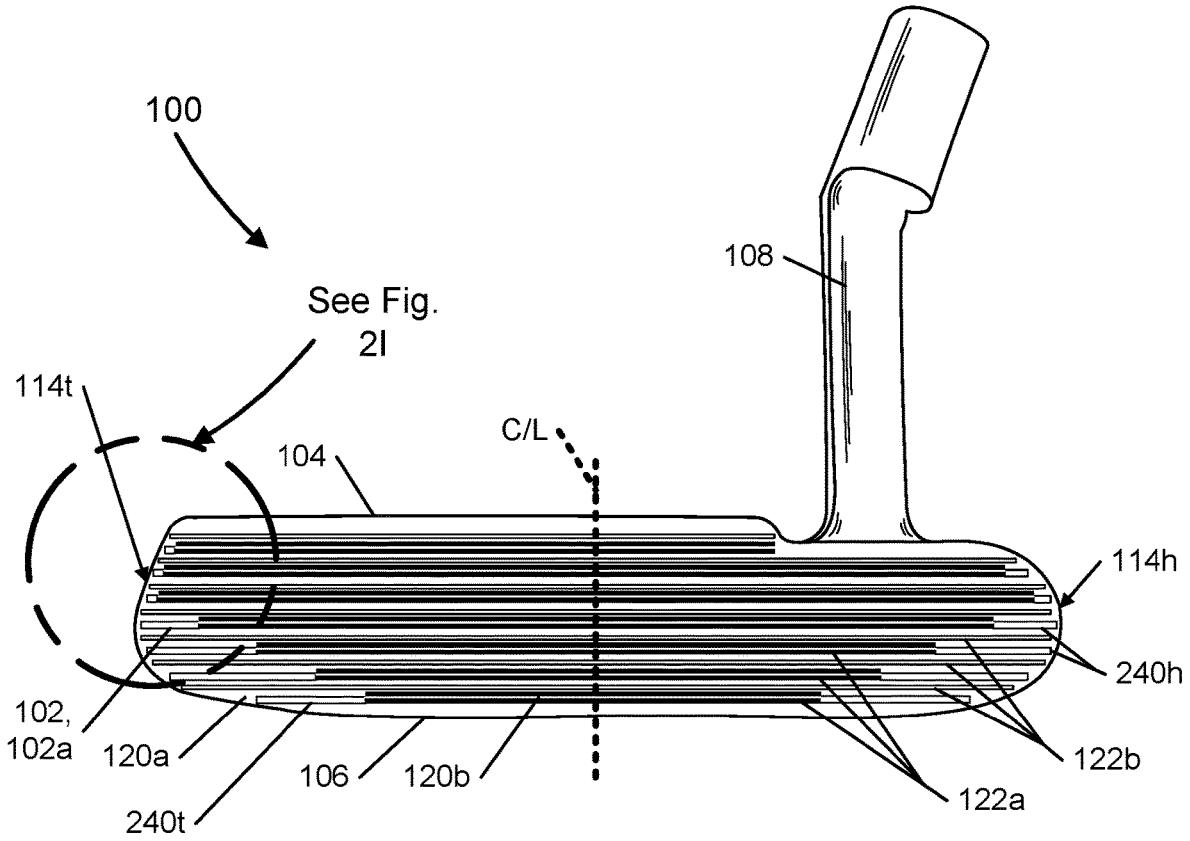
FIGS. 1A and 1B provide views of one example golf club head structure in accordance with this invention.

The reader is advised that the attached drawings are not necessarily drawn to scale.

DETAILED DESCRIPTION

In the following description of various example structures m accordance with the invention, reference is made to the accompanying drawings, which form a part hereof, and in which are shown by way of illustration various example golf club heads, golf club head parts, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use (e.g., orientation at address, orientation at a "standard" orientation position (e.g., a club head orientation at which measurements for determining compliance with USGA Rules are made)). Nothing in this specification should be construed as requiring a specific three dimensional or spatial orientation of structures in order to fall within the scope of this invention.

I. General Description of Various Golf Club Head Structures in Accordance with this Invention Aspects of this invention relate to golf club heads (e.g., putter heads, iron heads, etc.) that include a golf club head body having a ball striking face, a top, and a bottom, wherein an exposed ball striking surface at a top-to-bottom center line of the ball striking face includes a first material (e.g., a metal or a polymer material) having a first hardness and a second material (e.g., a polymer material) having a second hardness different from the first hardness (e.g., the second material may be softer than the first material). The ball striking face of this example may include: (a) a first plurality of grooves (e.g., two to ten grooves, and in some examples, at least four grooves, at least six grooves, etc.), wherein each groove of the first plurality of grooves includes a first edge formed from the first material and a second edge opposite the first edge formed from the second material, and (b) a second plurality of grooves (e.g., two to ten grooves, and in some examples, at least four grooves, at least six grooves, etc.), wherein each groove of the second plurality of grooves includes a first edge formed from the first material and a second edge opposite the first edge also formed from the first material. In at least some example structures, the first plurality of grooves may be arranged in an alternating manner with the second plurality of grooves in a direction along the top-to-bottom center line of the ball striking face.

In at least some examples of this aspect of the invention, at least one of the first plurality of grooves (or even at least half or each of the first plurality of grooves) will have a height dimension in a top-to-bottom direction at the top-to-bottom center line of the ball striking face that is greater than a height dimension of at least one of the second plurality of grooves (or even at least half or each of the second plurality of grooves) in the top-to-bottom direction at the top-to-bottom center line of the ball striking face. As some more specific examples, at least one of the first plurality of grooves (or even at least half or each of the first plurality of grooves) may have a height dimension H1 in a top-to-bottom direction at the top-to-bottom center line of the ball striking face within a range of 0.6 mm to I mm, and at least one of the second plurality of grooves (or even at least half or each of the second plurality of grooves) may have a height dimension H2 in the top-to-bottom direction at the top-to-bottom center line of the ball striking face within a range of 0.3 mm to 0.7 mm. Additionally or alternatively, if desired, at least one, at least half, and/or each height dimension $H_1$ may be greater than 1.2 $H_3$, wherein $H_3$ is a largest height dimension $H_2$ of the height dimensions of the second plurality of grooves (at least one, at least half, and/or each height dimension $H_1$ may be greater than 1.4 $H_3$ and/or at least one, at least half, and/or each height dimension $H_1$ may be between 1.25 $H_3$ and 1.75 $H_3$).

In at least some golf club head structures in accordance with this aspect of the invention, the golf club head body includes a toe edge and a heel edge. In one or more of the individual grooves of the first plurality of grooves, the second material forming the second edge of the individual groove(s) will extend across a central portion of the exposed ball striking surface, but this second material forming the second edge of the individual groove(s) does not extend to the toe edge or to the heel edge of the golf club head body. In such structures, the first material may include (a) one or more heel edge grooves that extend contiguously from a heel end of a corresponding one or more of the individual grooves of the first plurality of grooves toward the heel edge of the golf club head body and/or (b) one or more toe edge grooves that extend contiguously from a toe end of a corresponding one or more of the individual grooves of the first plurality of grooves toward the toe edge of the golf club head body.

If desired, the first material may form a majority of the golf club head (e.g., putter head, an iron head, etc.) and the second material may be fit into openings or recesses formed in the first material (e.g., one or more blind holes or openings formed in the ball striking surface). Alternatively, if desired, the club head body may have a relatively large recess defined therein, and the first and second materials may form a ball striking face insert that is fit into this large recess.

Golf club heads (e.g., putter heads, iron heads, etc.) in accordance with another example aspect of this invention may include a golf club head body including a ball striking face, a top, and a bottom, wherein an exposed ball striking surface at a top-to-bottom center line of the ball striking face includes a first material (e.g., a metal or a polymer material) having a first hardness and a second material (e.g., a polymer material) having a second hardness different from the first hardness (e.g., the second material may be softer than the first material). A top-to-bottom cross section of the exposed ball striking surface at the top-to-bottom center line of the ball striking face of this example has a structure that includes alternating first material and second material and a plurality of grooves including: (a) a first groove defining a first recess in the exposed ball striking surface, wherein, in the cross section, a first edge of the first groove constitutes the first material and a second edge of the first groove opposite the first edge constitutes the second material, and (b) a second groove defining a second recess in the exposed ball striking surface (e.g., closer to the top than the first groove), wherein, in the cross section, a first edge of the second groove constitutes the first material and a second edge of the second groove opposite the first edge of the second groove constitutes the first material. The first groove has a first height dimension $H_1$ in a top-to-bottom direction at the top-to-bottom center line of the ball striking face and the second groove has a second height dimension $H_2$ in the top-to-bottom direction at the top-to-bottom center line of the ball striking face, and in some examples, $H_1$ 2: 1.2 $H_2$ (and optionally, H1 2: 1.4 H2, and/or 1.25 H2:S H1:S 1.75 H2).

In this example golf club head structure, the plurality of grooves further may include: (a) a third groove defining a third recess in the exposed ball striking surface (e.g., closer to the top than the second groove), wherein, in the cross section, a first edge of the third groove constitutes the first material and a second edge of the third groove opposite the first edge of the third groove constitutes the second material, and (b) a fourth groove defining a fourth recess in the exposed ball striking surface (e.g., closer to the top than the third groove), wherein, in the cross section, a first edge of the fourth groove constitutes the first material and a second edge of the fourth groove opposite the first edge of the fourth groove constitutes the first material. In such structures, the third groove has a third height dimension H3 in the direction extending along the ball striking face from the top to the bottom of the club head body and the fourth groove has a fourth height dimension H4 in the direction extending along the ball striking face from the top to the bottom of the club head body, and in some examples, H3 2: 1.2 H4 (and optionally, H3 2: 1.4 H4, and/or 1.25 H4: S H3: S 1.75 $H_4$. If desired, $H_1=H_3\pm10\%$ and/or $H_2=H_4\pm10\%$.

Golf club heads in accordance with this aspect of the invention also may include toe edge grooves and/or heel edge grooves in the first material of the types described above (e.g., that extend contiguously from a toe end or a heel end, respectively of the first groove (and/or the third groove)).

As some additional potential features of grooves in accordance with at least some examples of this invention, the first groove has (or the first plurality of grooves have) a first depth dimension D1 in a direction into (e.g., perpendicular to) the ball striking face at the top-to-bottom center line of the ball striking face and the second groove has (or the second plurality of grooves have) a second depth dimension D2 in the direction into (e.g., perpendicular to) the ball striking face at the top-to-bottom center line of the ball striking face. In at least some such structures, $D_1=0.8\ D_2$ to 1.2 $D_2$ (and in some examples, $D_1=0.9\ D_2$ to 1.1 $D_2$)|

Golf club heads (e.g., putter heads, iron heads, etc.) in accordance with another aspect of this invention include:

a golf club head body including a ball striking face, a top, a bottom, a heel edge, and a toe edge, wherein the ball striking face is constructed at least in part from a first material (e.g., a metal or polymer material) having a first hardness, and wherein the ball striking face further includes: (a) a first elongated channel extending from a top-to-bottom center line of the ball striking face toward the heel edge and from the top-to-bottom center line toward the toe edge, wherein the first elongated channel optionally constitutes a first blind hole, (b) a second elongated channel separated from the first elongated channel at the ball striking face by a first portion of the first material, wherein the second elongated channel extends from the top-to-bottom center line of the ball striking face toward the heel edge and from the top-to-bottom center line toward the toe edge, wherein the second elongated channel optionally constitutes a second blind hole, and (c) a first groove defining a first recess in the first portion of the first material between the first elongated channel and the second elongated channel, and wherein, at the top-to-bottom center line, a first edge of the first groove constitutes the first material and a second edge of the first groove opposite the first edge of the first groove constitutes the first material;

a first fill material partially filling the first elongated channel, wherein the first fill material (e.g., a polymer material) has a different hardness than the first material of the ball striking face (e.g., softer than the ball striking face first material), wherein a first portion of the first fill material extends flush to the ball striking face and a second portion of the first fill material at least partially defines a second groove, and wherein a first edge of the second groove constitutes the first material and a second edge of the second groove opposite the first edge of the second groove constitutes the first fill material; and a second fill material partially filling the second elongated channel, wherein the second fill material (e.g., a polymer material) has a different hardness than the first material of the ball striking face (e.g., softer than the ball striking face first material), wherein a first portion of the second fill material extends flush to the ball striking face and a second portion of the second fill material at least partially defines a third groove, and wherein a first edge of the third groove constitutes the first material and a second edge of the third groove opposite the first edge of the third groove constitutes the second fill material, and wherein the first fill material is separate and independent from the second fill material. The first and second fill materials may be the same or different and/or may have the same or different hardness characteristics.

In these example golf club head structures, the first groove has a first height dimension H10 in a top-to-bottom direction at the top-to-bottom center line of the ball striking face, the second groove has a second height dimension $H_{11}$ in the top-to-bottom direction at the top-to-bottom center line of the ball striking face, and the third groove has a third height dimension $H_{12}$ in the top-to-bottom direction at the top-to-bottom center line of the ball striking face. In at least some examples of this invention one or more of the following relationships will apply: $H_{10}<H_{11}$; $H_{10}<H_{12}$; $H_{10}<0.8\ H_{11}$ and $H_{10}<0.8\ H_{12}$; and/or $H_{10}<0.7$ H11 and H10<0.7 H12.

In at least some examples of this aspect of the invention, the first fill material may have an L-shaped (or "7-shaped") cross section and/or may be formed of a first polymer member. Additionally or alternatively, the second fill material may have an L-shaped (or "7-shaped") cross section and/or may be formed of a second polymer member (and the second polymer material may be the same as or different from the first polymer material and/or may have the same or different hardness as the first polymer material, when both are present).

Golf club heads in accordance with this aspect of the invention also may include toe edge grooves and/or heel edge grooves in the first material of golf club head body, e.g., of the types described above (e.g., that extend contiguously from a toe end or a heel end), respectively of the second groove and/or the third groove.

Golf club heads (e.g., putter heads, iron heads, etc.) in accordance with still another aspect of this invention include: a golf club head body including a ball striking face, a top, and a bottom, wherein an exposed ball striking surface at a top-to-bottom center line of the ball striking face includes: (a) a top-most groove edge, (b) a bottom-most groove edge, and (c) a plurality of grooves defined in the ball striking face between the top-most groove edge and the bottom-most groove edge, wherein (i) a first subset of the plurality of grooves includes one or more grooves having a first edge formed from a first material of the ball striking face and a second edge opposite the first edge formed from a second material of the ball striking face, and wherein the first material is different from the second material and (ii) a second subset of the plurality of grooves includes one or more grooves having a first edge formed from the first material and a second edge opposite the first edge formed from the first material. In such structures, along the top-to-bottom center line of the ball striking face from the top-most groove edge to the bottom-most groove edge, the exposed ball striking surface (e.g., the plane defined by the ball striking surface) includes at least 25% of the first material, at least 20% of the second material, and at least 35% open space corresponding to locations of the plurality of grooves. In some examples, along the top-to-bottom center line of the ball striking face from the top-most groove edge to the bottom-most groove edge, the exposed ball striking surface may include at least 28% of the first material, at least 20% of the second material, and at least 38% open space corresponding to locations of the plurality of grooves. In yet some further examples, along the top-to-bottom center line of the ball striking face from the top-most groove edge to the bottom-most groove edge, the exposed ball striking surface may include at least 30% of the first material, at least 22% of the second material, and at least 40% open space corresponding to locations of the plurality of grooves.

Golf club heads according to this aspect of the invention also may have any of the other features described above (e.g., toe edge grooves, heel edge grooves, groove dimensional features, etc.).

Figure 1B:
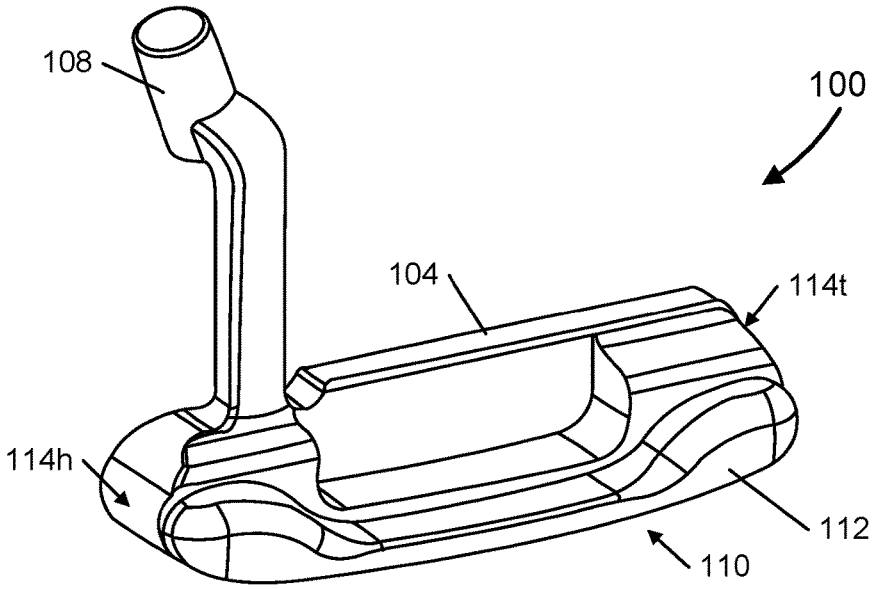

II. Detailed Description of Specific Example Golf Club Head Structures in Accordance with Aspects of this Invention FIGS. 1A and 1B illustrate front and rear perspective views, respectively, of a golf club head (e.g., a putter head 100) in accordance with some examples of this invention. This example putter head 100 including a ball striking face 102 (including an exposed ball striking surface 102*a*), a top 104, a bottom 106, and a hosel 108 for engaging a shaft (not shown). The rear 110 of the putter head 100 includes a weight member 112, e.g., with weight positioned low, rearward, and/or toward the heel side 114*h* and/or the toe side 114*t* of the club head 100. The head 100, weight 112, and/or other features of the club head 100 may take on any desired type of shape or body style without departing from this invention (e.g., blade putters, mallet putters, high MOI putters, blade irons, cavity back irons, muscle back irons, perimeter weighted irons, etc.).

As one specific example, if desired, aspects of this invention may be used in combination with the club head weighting and structural features as described, for example, in: (a) U.S. Pat. No. 9,072,948 (based on U.S. patent application Ser. No. 13/308,079, filed Nov. 30, 2011 in the names of David Franklin, John Stites, Robert Boyd, and Jeremy Snyder); (b) U.S. patent application Ser. No. 14/290,393 (filed May 29, 2014 in the names of David N. Franklin and Brian Kammerer), (c) U.S. patent application Ser. No. 14/290,398 (filed May 29, 2014 in the names of David N. Franklin and Brian Kammerer), (d) U.S. Provisional Patent Appln. No. 62/004,796 (filed May 29, 2014 in the names of David N. Franklin and Raymond J. Sander), (e) U.S. patent application Ser. No. 14/723,979 (filed May 28, 2015 in the name of Raymond J. Sander), (f) U.S. patent application Ser. No. 14/724,024 (filed May 28, 2015 in the name of Raymond J. Sander), (g) U.S. patent application Ser. No. 14/726,220 (filed May 29, 2015 in the names of David N. Franklin and Raymond J. Sander), (h) U.S. patent application Ser. No. 14/726,290 (filed May 29, 2015 in the names of David N. Franklin and Michael Wallans), and (i) concurrently filed U.S. patent application Ser. No. 14/994,786, filed Jan. 13, 2016, entitled "Golf Clubs and Golf Club Heads" in the names of David Franklin, Jamil Jacaman, and Brian Kammerer. Each of these patents and patent applications (i.e., items (a) through (i) above) is entirely incorporated herein by reference.

When oriented in a ball address position (e.g., in a "normal address position" for making measurements and/or otherwise determining whether the club head 100 complies with The Rules of Golf as promulgated by the United States Golf Association or other ruling bodies), the ball striking face 102 of the club head 100 will include a top-to-bottom center line C/L. As the term is used in this application, the top-to-bottom centerline C/L of the ball striking face 102 is located along the ball striking face 102 where a vertical plane that passes through the club head 100's center of gravity intersects the ball striking face 102 (with the club head 100 oriented in a normal ball address position, as described above).

Various aspects of this invention relate to features of the ball striking face 102 and the ball striking surface 102*a* of the club head. As shown in FIG. 1A (and as will be described in more detail below), the ball striking surface 102*a* of this example includes: (a) a first material 120*a* (e.g., a material that makes up a majority of the ball striking face 102 and/or the club head 100, such as a metal material (e.g., aluminum, titanium, other metals; alloys of aluminum, titanium, and/or other metals; metals and/or alloys conventionally used in golf club head constructions, etc.), or a polymer material (e.g., a thermoplastic polyurethane, a thermosetting polyurethane, etc.) having a first hardness and (b) a second material 120*b* (e.g., a polymeric material, such as a thermoplastic polyurethane, a thermosetting polyurethane, a rubber, etc.) having a second hardness different from the first hardness. In FIG. 1A, the second material 120*b* is shown with heavy, dark shading to more clearly distinguish it from the first material 120*a*. While these features will be described in more detail below, as generally shown in FIG. 1A, the ball striking face 102 of this club head 100 includes: (a) one or more grooves 122*a* (e.g., a first plurality of grooves) having a first edge formed from the first material 120*a* and a second edge opposite the first edge formed from the second material 120*b* and (b) one or more other grooves 122*b* (e.g., a second plurality of grooves) having a first edge formed from the first material 120*a* and a second edge opposite the first edge also formed from the first material 120*a*.

Any desired numbers, shapes, arrangements, and/or relative arrangements of the first groove(s) 122*a* and the second groove(s) 122*b* can be used without departing from this invention. For example, in this illustrated structure 100, the first plurality of grooves 122*a* are arranged in an alternating manner with the second plurality of grooves 122*b* in a direction along the top-to-bottom center line C/L of the ball striking face 102. If desired, the first plurality of grooves

122*a* may include from 2-10 separated grooves 122*a*, and in some examples, at least four separated grooves 122*a* or even at least six separated grooves 122*a*. Similarly, if desired, the second plurality of grooves 122*b* may include from 2-10 separated grooves 122*b*, and in some examples, at least four separated grooves 122*b* or even at least six separated grooves 122*b*.

Figure 2B:
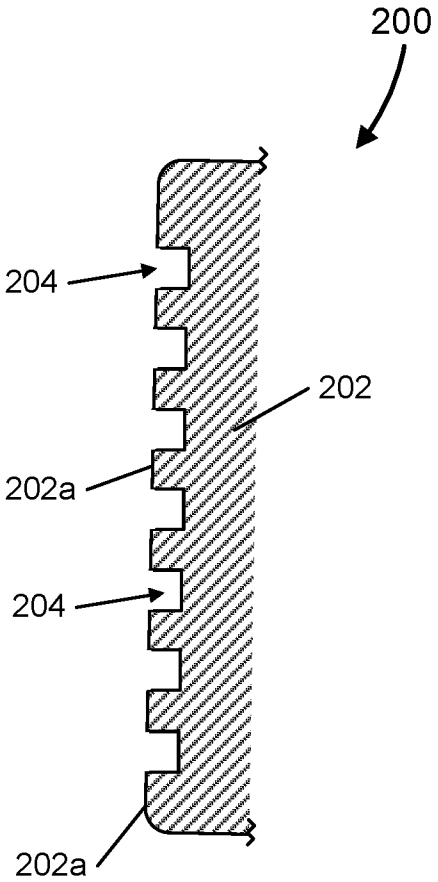
FIGS. 2A-2J provide views of various features of golf club head structures in accordance with this invention and methods of making these structures.
Figure 2A:
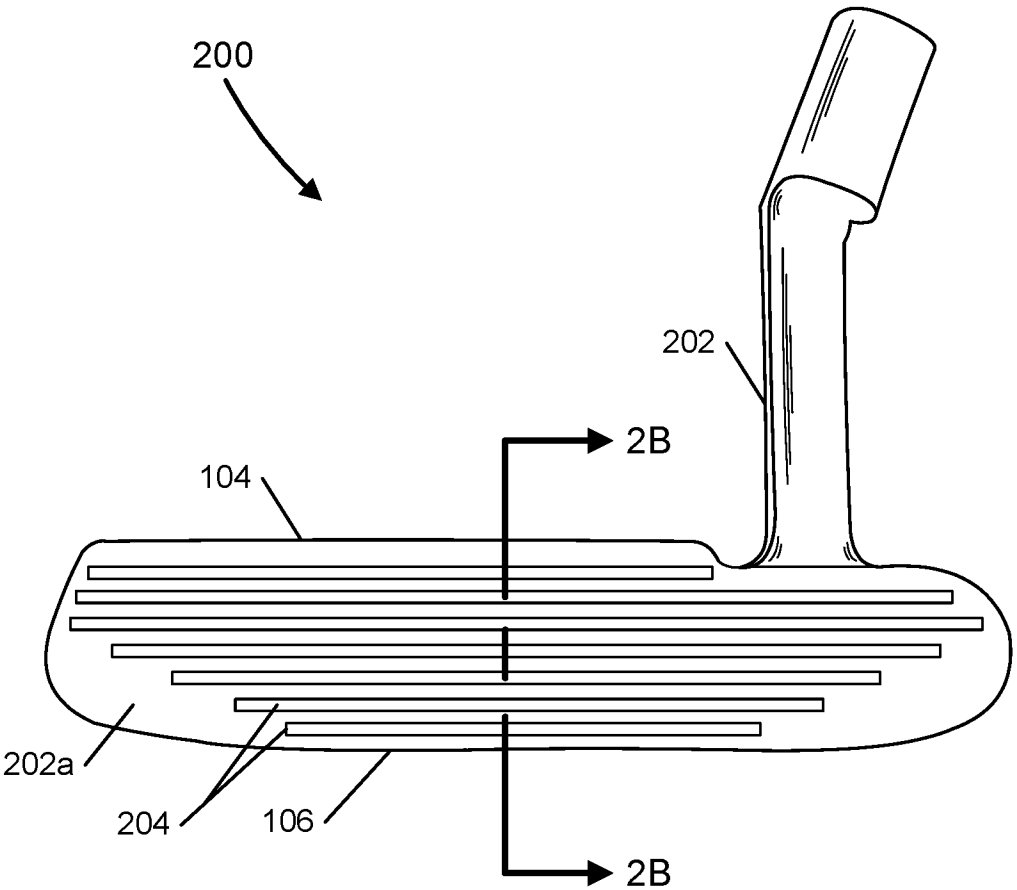

Some examples of the structure of club head 100 now will be described in more detail in conjunction with FIGS. 2A-2J, which also help illustrate at least some examples of a method for making club heads 100 in accordance with at least some examples of this invention. FIG. 2A is a front view and FIG. 2B is a partial cross sectional view taken along line 2B-2B of FIG. 2A, and these figures illustrate an example step of the club head 100 production procedure. More specifically, as shown in FIGS. 2A and 2B, a club head base 200 is made, e.g., from one or more parts. In this illustrated example, the club head base 200 includes the basic structure of a putter head body 202, e.g., made by casting techniques, forging techniques, molding techniques, and/or in any other desired manner, including in manners and/or with materials (e.g., first material 120*a* described above) conventionally known and/or used in the golf club arts. When made from multiple parts, the multiple parts forming the club head base 200 may be engaged together in any desired manner, such as welding or other fusing techniques, adhesives or cements, mechanical connectors, or the like, including in manners conventionally known and used in the golf club arts. The exposed face 202*a* of the club head body 202 (which will form a portion of the ball striking face 102*a* in the final club head structure 100 of this example) includes one or more relatively deep recesses 204 defined in it. The recess(es) 204 may be integrally formed when the club head body 202 is produced, or it/they may be formed in the face 202*a* after the club head body 202 is produced (e.g., using a grinding or other machining action). In this illustrated example, the recesses 204 are formed as blind holes (and/or elongated channels) extending inward (e.g., perpendicularly) from the ball striking face 202*a*.

Figure 2D:
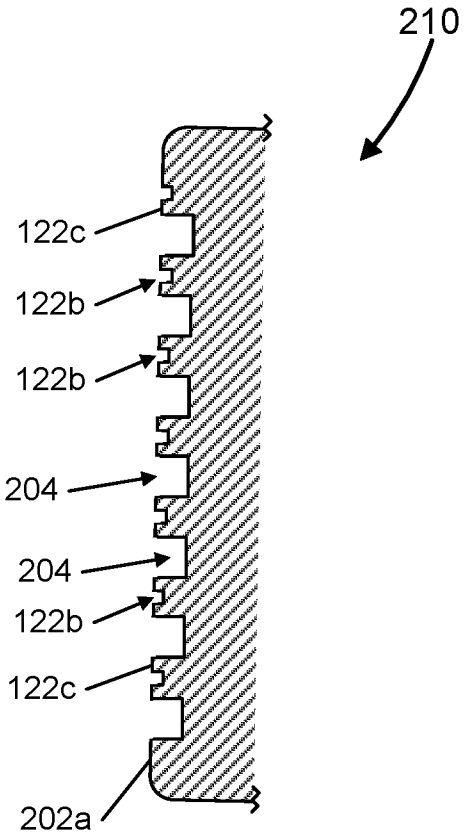
Figure 2C:
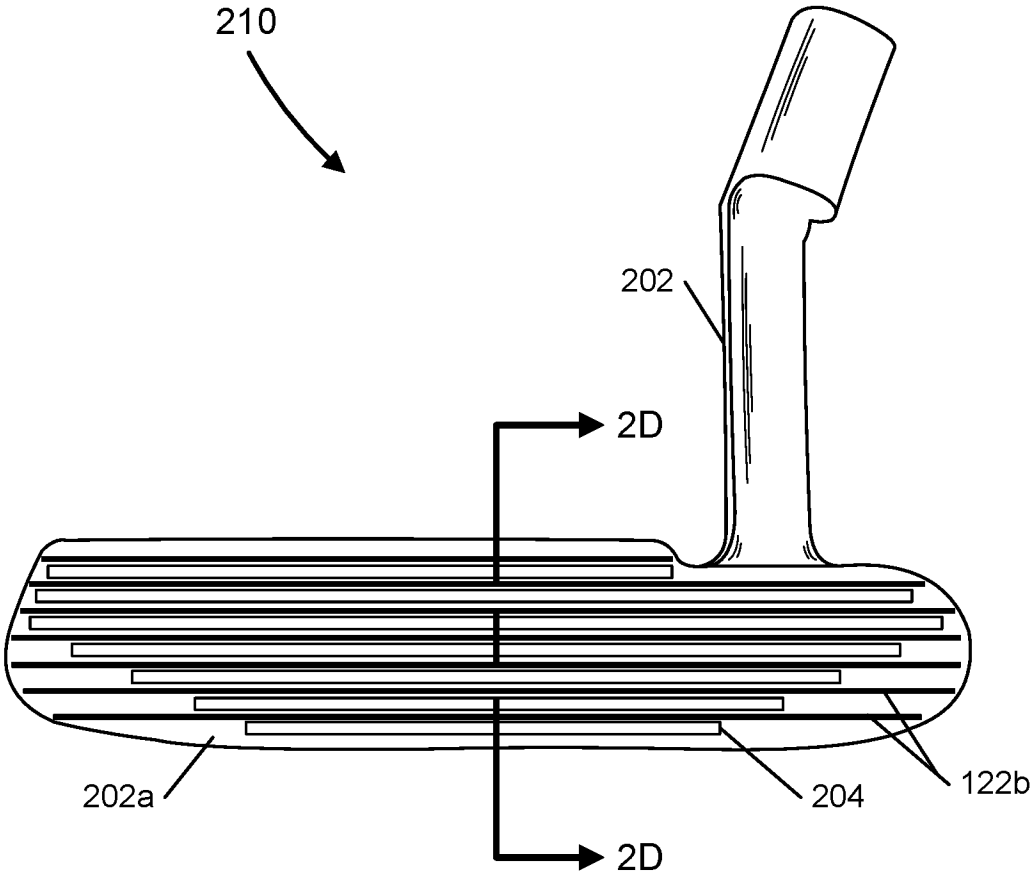

Other steps of this example procedure are shown with reference to FIG. 2C (front view) and FIG. 2D (a partial cross section view along line 2D-2D in FIG. 2C). In these steps, an intermediate club head member 210 is formed. As shown in these figures, one or more (e.g., the second plurality of) grooves 122*b* are formed in the exposed ball striking face 202*a* to thereby provide the intermediate club head member 210. These groove(s) 122*b* (which are shown shaded black in FIG. 2C to more clearly distinguish from the recesses 204) may be formed, for example, by a grinding or machining step. Alternatively, if desired, the groove(s) 122*b* may be formed during initial production of the club head base 200 shown in FIG. 2A (e.g., by integrally forming groove(s) 122*b* with the remainder of the club head base 200 in any of the various manners described above).

Figure 2F:
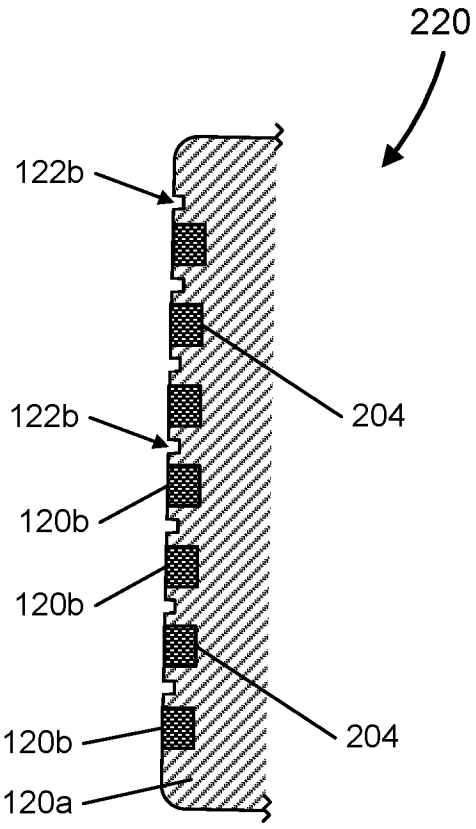
Figure 2E:
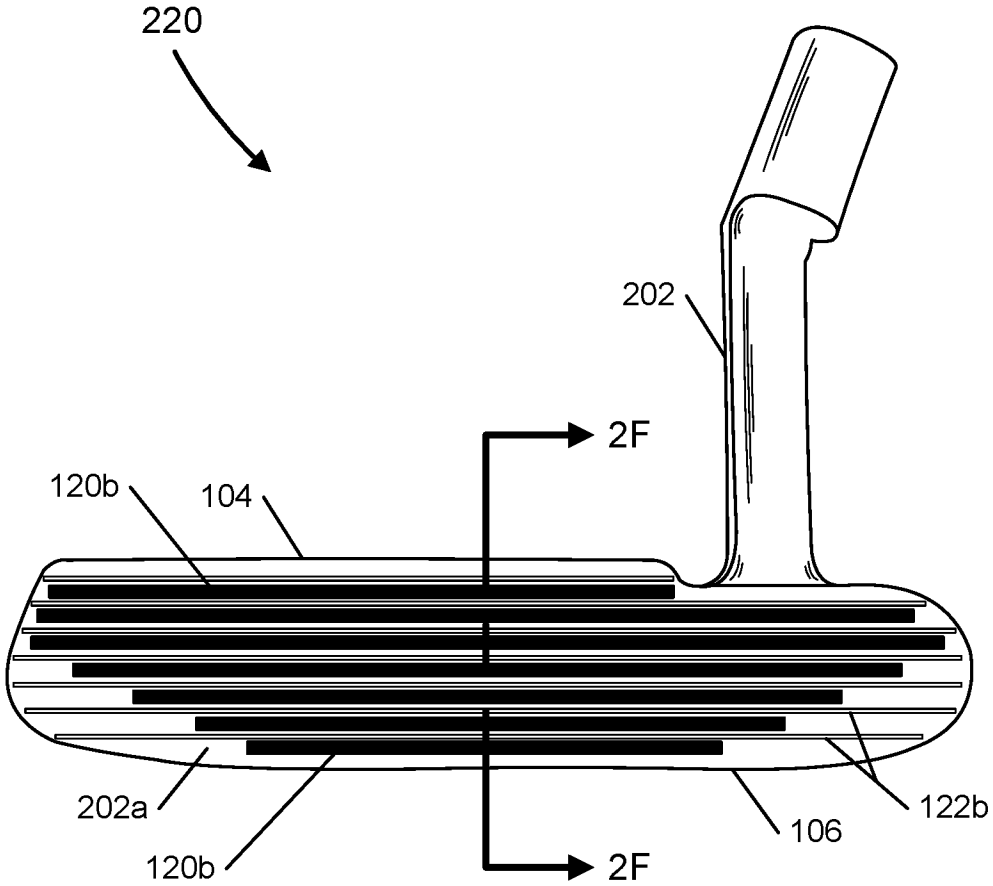

Additionally, in this example process, club head intermediate member 220 is formed as shown in the front and partial cross section views of FIGS. 2E and 2F, respectively. In this step, the relatively deep recesses 204 are at least partially filled with the second material 120*b*, e.g., a polymer material that is softer than the material making up the face 202*a* of the club head body 202. To distinguish from the grooves 122*b*, the second material 120*b* filling the recesses 204 is shown with black and dark cross hatching in FIGS. 2E and 2F, respectively.

This step may be accomplished in any desired manner without departing from this invention.

For example, if desired, the second material 120*b* may be formed as solid bars or other structures of material 120*b* that are fit into the recesses 204 and secured therein, e.g., by cements or adhesives. As another example, the recesses 204 may be filled with a liquid, semi-solid, or otherwise moldable polymeric material that is then cured or otherwise hardened in place. As yet another option, if desired, the recesses 204 could be formed in a shape so as to prevent the material 120*b* (which may be complementary shaped) from sliding outward (e.g., a dovetail type or other "retaining structure" type connection).

Figure 2G:
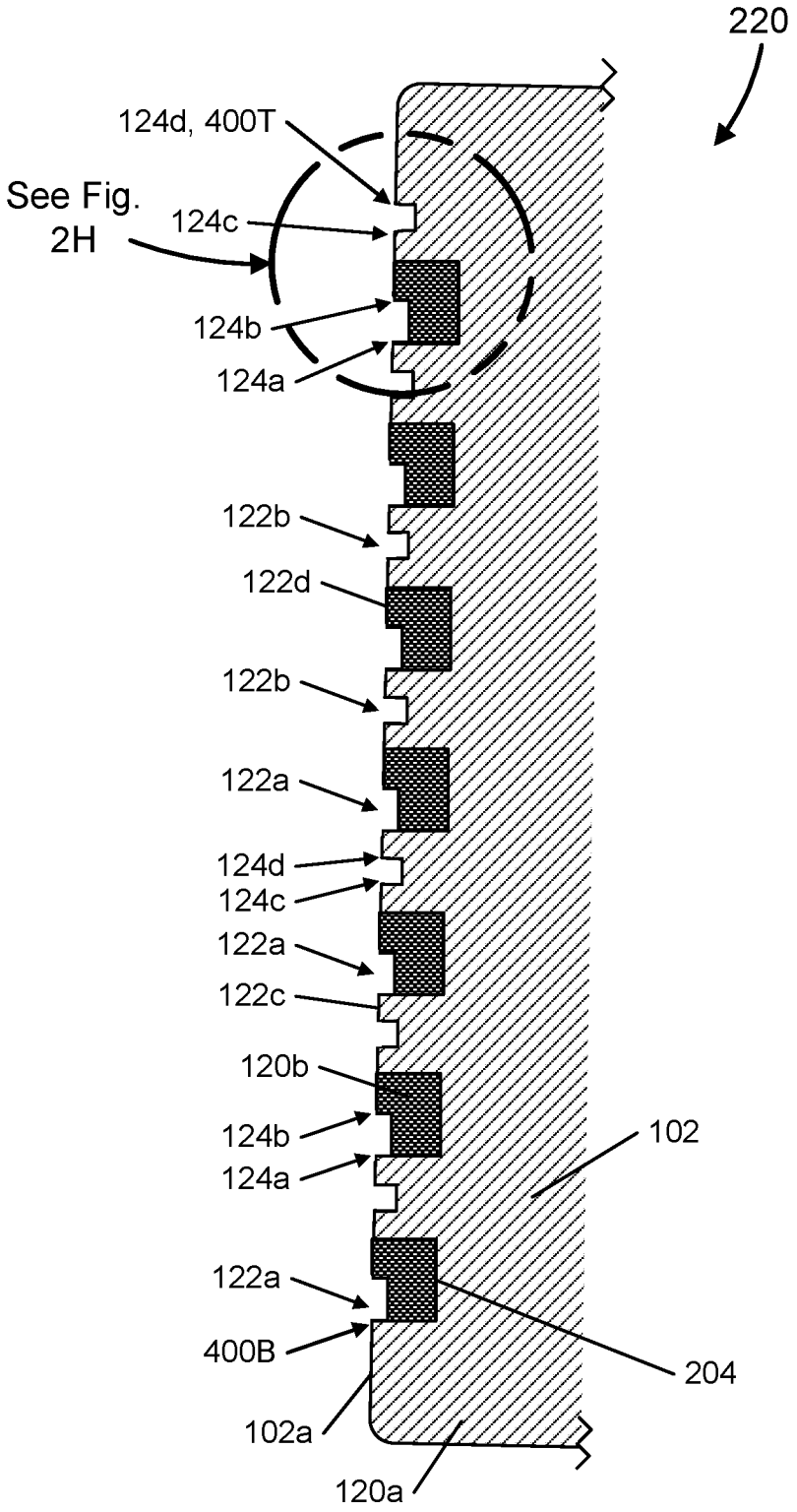

As another step in the process, as shown in the cross sectional view of FIG. 2G, the first groove(s) 122*a* may be formed in at least one of the material 120*b* filling the recess(es) 204 or the material 120*a* forming the ball striking surface 102*a*. One or more of the groove(s) 122*a* may be formed such that one edge 124*a* of the groove 122*a* is defined by the material 120*a* of the ball striking face 102 and the opposite edge 124*b* of that same groove 122*a* is defined by the material 120*b* partially filling the recess(es) 204. Note also FIG. 2H, which is an enlarged view of the area shown in circle 2H of FIG. 2G. Notably, as also shown in FIG. 2H, each of the opposite edges 124*c* and 124*d* of grooves 122*b* are defined by the material 120*a* of the ball striking face 102.

While other structures are possible, in this illustrated example, the material 120*b* partially filling the recesses 204 has a generally L-shaped (or "7-shaped") cross section. The material 120*b* partially filling the different recesses 204 may be the same or different without departing from this invention. If different, the material 120*b* partially filling at least one (and optionally, at least half or even all) of the recesses 204 may be softer than the material 120*a* making up the ball striking face 102.

As evident from the above description and the noted figures, the grooves 122*a* may be formed at the ball striking surface 102*a* of the club head 100, at a bottom junction between the first material 120*a* and the exposed second material 120*b*. FIGS. 2G and 2H show the grooves 122*a* arranged such that the harder material 120*a* forms the bottom edge 124*a* of the groove 122*a* and the softer material 120*b* forms the top edge 124*b* of that same groove 122*a*. Other options are possible, however, without departing from this invention. For example, one or more of the grooves 122*a* could be formed at a top junction between the first material 120*a* and the exposed second material 120*b* such that at least some of the grooves 122*a* include the harder material 120*a* forming the top edge of the groove 122*a* and the softer material 120*b* forming the bottom edge of that same groove 122*a* (e.g., as shown by grooves 210 in FIG. 3 of U.S. Pat. No. 7,806,779). As another potential option, grooves 122*a* could be formed at both the top and bottom junctions of the first material 120*a* and the exposed second material 120*b* (e.g., as shown by grooves 210 in FIG. 2D of U.S. Pat. No. 7,806,779). Also, while FIGS. 2G and 2H of the present application show the grooves 122*a* formed only in the softer material 120*b* that partially fills the recesses 204, other options are possible. For example, if desired, for at least some of the grooves 122*a*, the groove 122*a* may be formed only in the harder material 120*a* at a junction of the first material 120*a* and the exposed second material 120*b* (e.g., as shown by grooves 210 in FIG. 4 of U.S. Pat. No. 7,806,779) and/or for at least some of the grooves 122*a*, the groove 122*a* may be formed in both the harder first material 120*a* and the softer second material 120*b* (e.g., so that the groove 122*a* bridges the junction of the harder first material 120*a* and the softer second material 120*b*, for example, as shown by grooves 210 in FIG. 2C of U.S. Pat. No. 7,806, 779). Any one or more of these groove arrangements or structures may be provided in a single club head structure without departing from this invention.

Figure 2H:
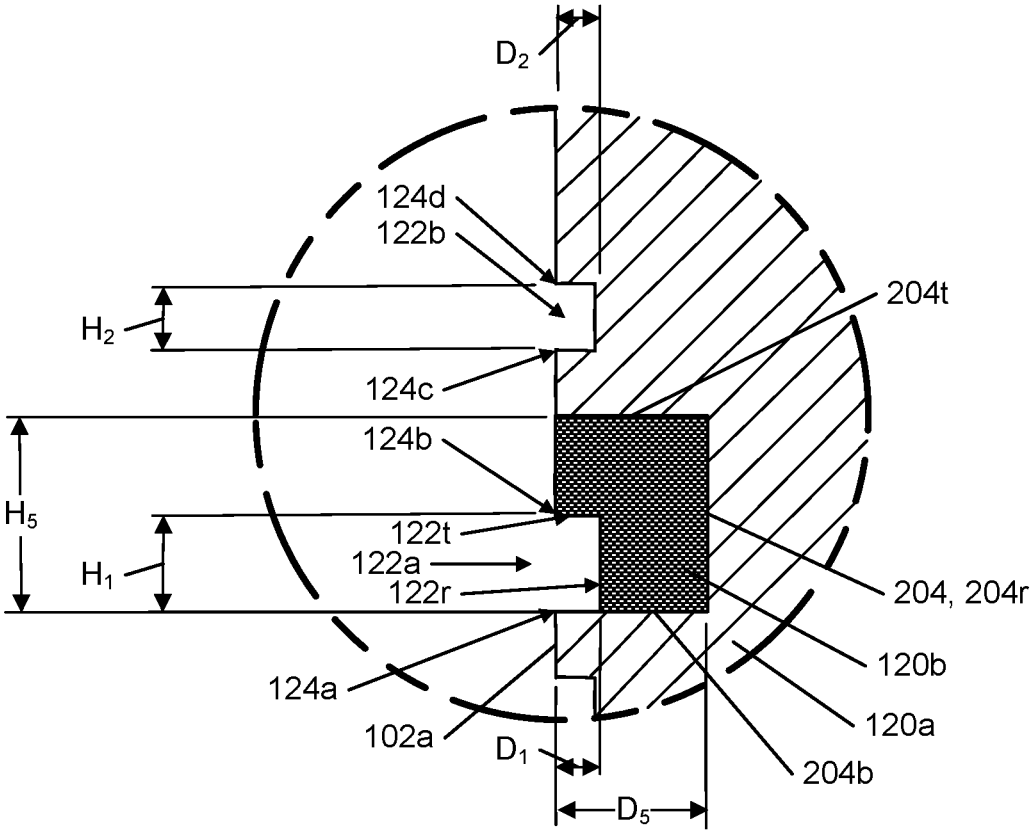
Figure 2I:
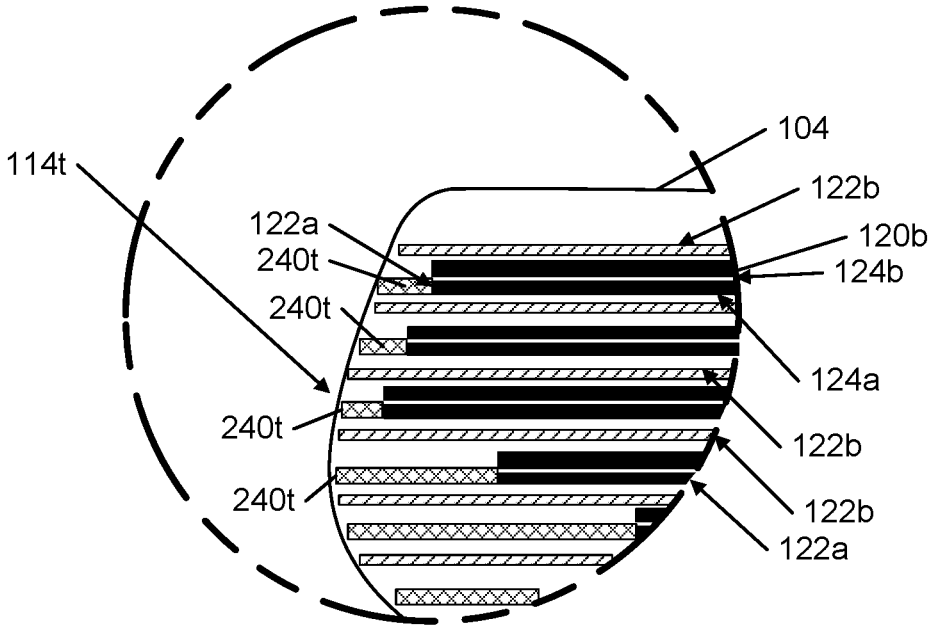

FIG. 2H illustrates other potential features of golf club heads 100 and/or the grooves defined therein in accordance with at least some examples of this invention. For example, as shown in FIG. 2H, if desired, at least one (and optionally, at least half or even all) of the first plurality of grooves 122*a* may have a height dimension H1 in a top-to-bottom direction of the ball striking face 102 at the top-to-bottom center line C/L of the ball striking face 102 that is greater than a height dimension H2 of at least one of the second plurality of grooves 122*b* in the top-to-bottom direction at the top-to-bottom center line half C/L of the ball striking face 102 (and optionally, a height dimension $H_1$ that is greater than a height dimension $H_2$ of one of the immediately adjacent grooves 122*b*, at least half of the second plurality of grooves 122*b*, or optionally all of the second plurality of grooves 122*b*). As some additional examples, H1 and H2 may have any one or more of the following properties:

$$H_1 \geq 1.2H_3|$$

$$H_1 \geq 1.4H_3|$$

$$1.2H_3 \leq H_1 \leq 2H_3$$

$$1.25H_3 \leq H_1 \leq 1.75H_3$$

$$H_3 \leq 0.8H_1|$$

$$H_3 \leq 0.7H_1|$$

wherein $H_3$ is a largest height dimension $H_2$ of the height dimensions of the second plurality of grooves 122*b* at the top-to-bottom center line C/L of the ball striking face 102. Additionally or alternatively, the groove 122*a* height $H_1$ of one or more grooves 122*a* may be within a range of 25% to 75% of the height Hs of the polymer material 120*b* exposed within the corresponding recess 204 and/or of the height $H_5$ of the recess 204 at the top-to-bottom center line C/L, and in some examples, within a range of 35% to 60% of Hs.

When multiple grooves 122*a* (e.g., a "first plurality of grooves" 122*a*) are present, the grooves 122*a* within that plurality may have the same or different height dimensions $H_1$ in the top-to-bottom direction at the top-to-bottom center line C/L of the ball striking face 102. As some more specific examples, the grooves 122*a* within that plurality may have height dimensions $H_1$ in the top-to-bottom direction at the top-to-bottom center line C/L within 25% of the height dimension $H_1$ of at least one other groove 122*a* within that plurality of grooves 122*a*, and in some examples, within 10% of the height dimension $H_1$ of at least one other groove 122*a* within that plurality of grooves 122*a*. If desired, a majority or even all of the height dimensions $H_1$ of the plurality of grooves 122*a* may lie within 25% or even within 10% of the median or average height dimensions $H1_{,Ave}$ of the plurality of grooves 122*a*.

Similarly, when multiple grooves 122*b* (e.g., a "second plurality of grooves" 122*b*) are present, the grooves 122*b* within that plurality may have the same or different height dimensions $H_2$ in the top-to-bottom direction at the top-to-bottom center line C/L of the ball striking face 102. As some more specific examples, the grooves 122*b* within that second plurality of grooves 122*b* may have height dimensions H2 in the top-to-bottom direction at the top-to-bottom center line C/L within 25% of the height dimension $H_2$ of at least one other groove 122*b* within that plurality of grooves 122*b*, and in some examples, within 10% of the height dimension $H_2$ of at least one other groove 122*b* within that plurality of grooves 122*b*. If desired, a majority or even all of the height dimensions $H_2$ of the plurality of grooves 122*b* may lie within 25% or even within 10% of the median or average height dimensions $H_{2,Ave}$ of the plurality of grooves 122*b*.

As some examples of absolute dimensions, if desired, one or more (e.g., at least half, or even all) of the first plurality of grooves 122*a* may have a height dimension $H_1$ in the top-to-bottom direction at the top-to-bottom center line C/L of the ball striking face 102 within a range of 0.4 mm to 1.25 mm, and in some examples, from 0.5 mm to I mm. Additionally or alternatively, one or more (e.g., at least half, or even all) of the second plurality of grooves 122*b* may have a height dimension $H_2$ in the top-to-bottom direction at the top-to-bottom center line C/L of the ball striking face 102 within a range of 0.2 mm to 0.9 mm, and in some examples, from 0.3 mm to 0.7 mm. Additionally or alternatively, if desired, one or more of the recesses 204 may have a height dimension $H_5$ within a range of I mm to 5 mm, and in some examples, from 1.2 mm to 3.5 mm, or even from 1.25 mm to 2.5 mm.

Additionally or alternatively, as further illustrated in FIG. 2H, if desired, at least one (and optionally, at least half or even all) of the first plurality of grooves 122*a* may have a depth dimension $D_1$ in a front-to-back direction of the club head 100 at the top-to-bottom center line C/L of the ball striking face 102 that is the same as or different from a depth dimension $D_2$ of at least one of the second plurality of grooves 122*b* in front-to-back direction of the club head 100 at the top-to-bottom center line half C/L of the ball striking face 102. As some additional examples, D1 and D2 may have any one or more of the following sets of properties:

$$D_1 = D_3$$

$$D_1 = D_3 \pm 25\%$$

$$D_1 = D_3 \pm 10\%$$

wherein D3 is a largest depth dimension D2 of the depth dimensions of the second plurality of grooves 122*b* at the front-to-back direction at the top-to-bottom center line half C/L of the ball striking face 102*a*. As some more absolute dimensional numbers, one or more of the grooves 122*a* and/or 122*b* may have a depth at the heel-to-toe center line C/L (or a deepest depth throughout its length) within a range of 0.1 mm to 0.6 mm, and in some examples, 0.2 mm to 0.5 mm. All grooves 122*a* and/or 122*b* need not have the same depth dimensions $D_1$ and/or $D_2$, respectively, in a single club head structure 100. All groove depth dimensions as described above are measured in a direction perpendicular to the ball striking face 102 at the location of the bottom edges, e.g., 124*a* and/or 124*c*. Groove depth also may vary over the length (heel-to-toe length) and/or height of a given groove structure 122*a* and/or 122*b*, if desired.

As further shown in FIG. 2H, the relatively deep recesses 204 of this example structure have a depth dimension $D_S$ that is substantially greater than the depth dimension D1 of the groove 122*a* formed therein (and/or greater than the depth $D_2$ of grooves 122*b*). As some more specific examples, $D_5$ may be at least 2 times $D_1$ and/or $D_2$, and in some examples, at least 3 times D1 and/or D2. As some absolute dimensions, Ds may be within the range of 0.75 mm to 4 mm, or even from 0.9 mm to 2.5 mm or from 1 mm to 2 mm.

As noted above (and as shown in FIGS. 2G and 2H), the material 120*b* partially filling the recesses 204 in this example has a generally L-shaped (or "7-shaped") cross section. More specifically, in this illustrated example, the material 120*b*: (a) completely fills the rear of the recess 204 from the top 204*t* of the recess 204 to the bottom 204*b* of the recess 204, (b) extends continuously at the top 204*t* of the recess 204 from the ball striking surface 102*a* to the rear surface 204*r* of the recess 204, and (c) extends continuously at the bottom 204*b* of the recess 204 from a location inside the recess 204 (e.g., at depth $D_1$ in FIG. 2H) to the rear surface 204*r* of the recess 204. This construction leaves a gap at the bottom-front of the recess 204 corresponding to the groove 122*a* (and thus, the material 120*b* of the fill material forms the rear surface 122*r* and the top surface 122*t* of the groove 122*a*). In some examples of this invention, in the cross section (e.g., the top-to-bottom cross sections shown in FIGS. 2G and 2H), the fill material 120*b* will fill at least 70% of the area of the recess 204, and in some examples, at least 75%, at least 80%, or even at least 85% of this cross-sectional area. Alternatively, the open area defined by the groove 122*a* will occupy 30% or less of the area of the cross section of the recess 204, and in some examples, 75% or less, 80% or less, or even 85% or less of this cross-sectional area.

This recess/fill structure has various potential advantages. For example, it allows formation of a recess 204 that is substantially larger than the desired final groove size 122*a* (as described above), which makes the manufacturing processes somewhat easier (e.g., as greater tolerances and/or variations in the production processes can be accommodated, it is easier to handle the larger fill material parts that fill the recesses 204, etc.). The relatively large volume of fill material 120*b* (as compared to the groove 122*a* volume) also may provide more volume and space for the fill material 120*b* to interact with the ball (to compress the fill material 120*b* and/or grip the ball). The larger volume of fill material 120*b* also may lighten the club head somewhat (e.g., by replacing a corresponding volume of denser head material 120*a*) and optionally make additional discretionary weight available for selective placement at other locations in the club head structure 100. The completely filled rear volume of the recess 204 (filled with material 120*b*) also helps reinforce the face around the grooves 204 to prevent excess deformation, e.g., during a ball strike.

As noted above with respect to FIG. 1A, the golf club head body 102 of this example structure 100 includes a toe edge 114*t* and a heel edge 114*h*. FIG. 21, together with FIG. 1A, show additional potential groove features that may be provided at the toe edge 114*t* and/or at the heel edge 114*h* in this club head structure 100. More specifically, as shown in FIG. 1A, at least one (and optionally, at least half or even all) of the first plurality of grooves 122*a* and the second material 120*b* at least partially filling the deep recesses 204 and defining the groove(s) 122*a* (see also FIG. 2E) extends across a central portion of the exposed ball striking surface 102*a* (e.g., across center line C/L). But, the second material 120*b* and the groove(s) 122*a* formed therein do not necessarily extend to the extreme toe edge 114*t* or to the extreme heel edge 114*h* of the golf club head 100. If desired, as shown in FIGS. 1A and 21, the first material 120*a* (e.g., of the club head body) may be formed to include one or more toe edge grooves 240*t* that extend (optionally contiguously) from a toe end of the groove(s) 122*a* and/or fill material 120*b* and toward the toe edge 114*t* of the ball striking face 102. Additionally or alternatively, the first material 120*a* (e.g., of the club head body) may be formed to include one or more heel edge grooves 240*h* that extend (optionally contiguously) from a heel end of the groove(s) 122*a* and/or fill material 120*b* and toward the heel edge 114*h* of the ball striking face 102 in this same manner, as shown in FIG. 1A. The toe edge grooves 240*t* and/or heel edge grooves 240*h*, when present, can help reduce club head weight (and optionally make additional discretionary weight available for selective placement at other locations in the club head structure 100).

Figure 2J:
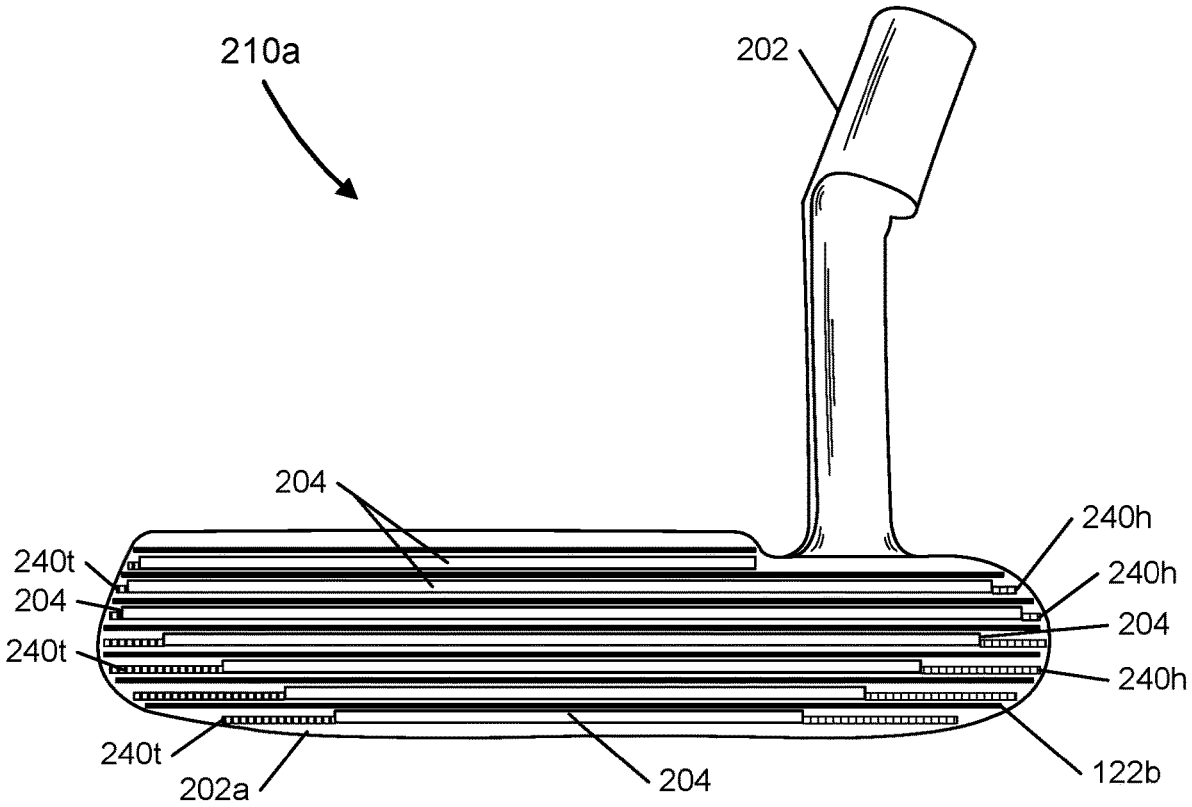

The toe edge grooves 240*t* and/or the heel edge grooves 240*h*, when present, may be formed at any desired time in the production process without departing from this invention. As a more specific example, these grooves 240*t* and/or 240*h* may be cut, machined into, or otherwise formed in the material 120*a* of the ball striking surface 102*a* at the same time that the grooves 122*a* are formed in the second material 120*b* partially filling the recesses 204 (e.g., in the step of FIG. 2G). As another option, the grooves 240*t* and/or 240*h* may be cut, machined into, or otherwise formed in the material 120*a* of the ball striking surface 102*a* at the same time that the grooves 122*b* are formed in the first material 120*a* (e.g., in the step shown in FIGS. 2C and 2D). In this option, the intermediate member may have the structure 210*a* shown in FIG. 2J. The toe edge grooves 240*t* and the heel edge grooves 240*h* are shown in FIG. 2J with different shading to distinguish from the grooves 122*b* and the recesses 204. The toe edge grooves 240*t* and the heel edge grooves 240*h*, when present, may have depths the same as or different from the depth $D_1$ and/or the depth $D_2$ of the first groove(s) 122*a* and/or the second grooves 122*b*, respectively (and optionally, within 25% and/or within 10% of the depths of any one or more of grooves 122*a* and/or 122*b*). As some more absolute dimensional numbers, one or more of the toe edge grooves 240*t* and/or the heel edge grooves 240*h* may have a deepest depth within a range of 0.1 mm to 0.6 mm, and in some examples, 0.2 mm to 0.5 mm. The depth(s) of these grooves 240*t* and/or 240*h* may vary along a heel-to-toe length of the groove (and optionally taper to be flush with the surface 102*a*, if desired).

As evident from FIGS. 1A, 2A, and 2E, the recesses 204, the exposed material 120*b* in the recesses 204, and/or the grooves 122*a* formed therein need not have a constant heel-to-toe length. Rather, as shown in these figures, the recesses 204 and the exposed material 120*b* in the recesses 204 (and the grooves 122*a* formed therein) may become progressively longer moving upward from the bottom 106 of the club head structure 100 until reaching a largest length dimension, e.g., at a location between the top 104 and bottom 106, and then getting progressively shorter further moving upward to the top 104. The outer edges of the exposed material 120*b* may form any desired shape without departing from this invention, including, for example, a generally triangular shape, rectangular shape, trapezoidal shape, parallelogram shape, pentagonal shape, hexagonal shape, other polygonal shapes, etc. (at least some portion of the exposed material 120*b* in the illustrated example club structure form a generally trapezoidal shape). Other options are possible, however, such as having two or more recesses 204 and/or grooves 122*a* (and the exposed material 120*b* therein) of the same heel-to-toe length and/or even having all grooves 122*a* (and the exposed material 120*b* therein) of the same heel-to-toe length.

Additional features of at least some example golf club head structures (e.g., putter head structures) in accordance with this invention relate to the surface finish of the club head face (e.g., the ball striking face 102 described above). For example, if desired, at locations other than the grooves (e.g., the "land areas" 122*c* between adjacent grooves 122*a*, 122*b* as shown in FIGS. 2D and 2G), the face 102 may be machined to be smooth. As some more specific examples, at these land areas 122*c*, the face 102 of the club head may be milled or otherwise machined or formed smooth, e.g., prior to the grooves 122*a* and/or 122*b* being cut into the face (e.g., before the steps shown in FIGS. 2A and 2B). Additionally or alternatively, if desired, the land areas 122*d* (FIG. 2G) formed by the exposed polymer material 120*b* received in the deep recesses 204 also may be formed or machined to be smooth. The surface finish at these land areas 122*c*, 122*d* (and, optionally, other areas of the ball striking face 102 other than the grooves 122*a*, 122*b*) may be formed within a smoothness range of Ra from 16 to 63 microinches, and in some examples, within a range of Ra from 22 to 50 microinches or even within an Ra range of 24 to 44 microinches (e.g., with an Ra of approximately 32 microinches in some examples). This same level of smooth surface finish also may extend to the areas (or at least to the land areas between grooves) to the heel side and/or toe side of the ball striking face 102 (e.g., the areas to the heel and toe sides of polymer material 120*b* and/or deep recesses 204).

Because of this smooth surface finish, the likelihood of creating or inducing any (or any significant) sidespin by the surface texture of the club face is greatly reduced. Some existing, commercial putter surfaces have purposefully created surface roughness, and this surface roughness may create significant sidespin (e.g., especially if the club head 102 strikes the ball at an angled direction with respect to the desired target line direction). Sidespin of this type can cause the ball to move off its intended line or path. By eliminating or reducing surface roughness (e.g., to within the ranges described above), the face 102 having the groove pattern (e.g., with grooves 122*a*, 122*b*) and the smoother surface finish (e.g., in land areas 122*c* and/or 122*d*) is set up to solely reduce backspin during impact and eliminate/reduce sidespin. Smooth surface finish of this type (and within these ranges) may be used in the other example club head constructions described in more detail below with respect to FIGS. 3A-3D.

While various potential production steps are described above in conjunction with FIGS. 2A-2J, the order of the various steps may be changed, steps may be combined into a single step, and/or some steps may be omitted without departing from this invention. Also, the various production methods and steps described above are simply examples of some possible steps and procedures. Other steps or procedures, e.g., that form the same or similar structures, may be used in producing club heads in accordance with at least some examples of this invention.

Figure 3A:
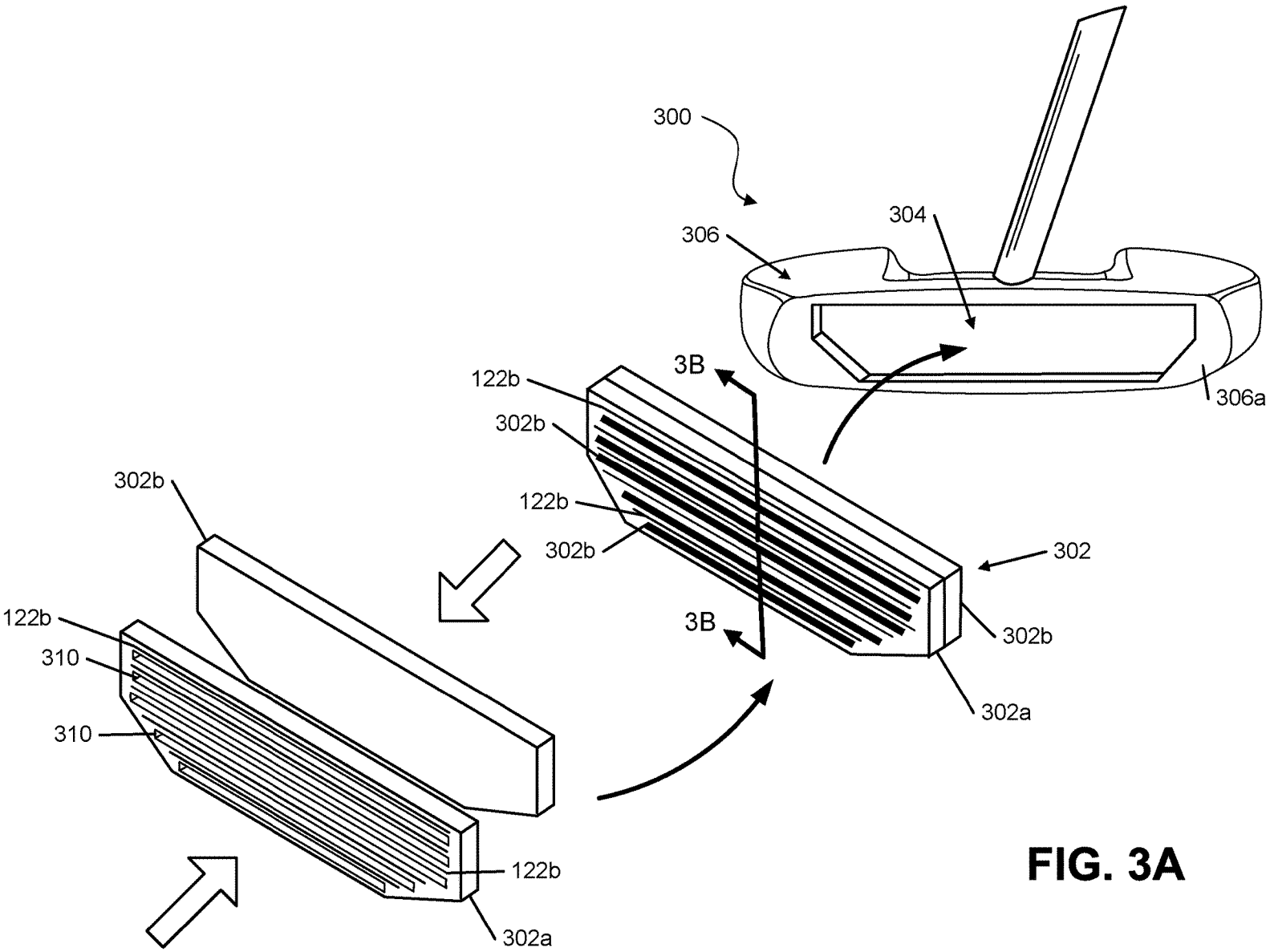
FIGS. 3A-3D provide views of various alternative features and/or golf club head structures in accordance with at least some examples of this invention.
Figure 3C:
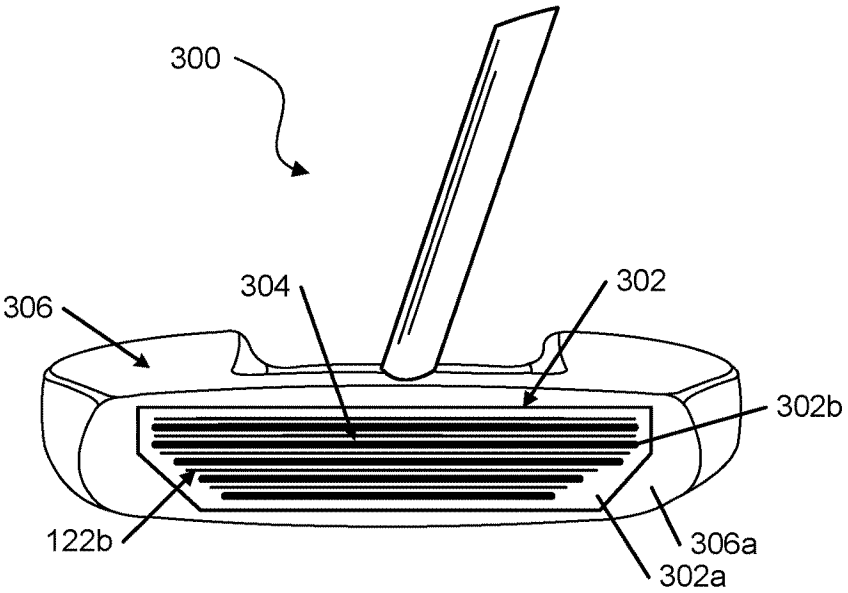
Figure 3B:
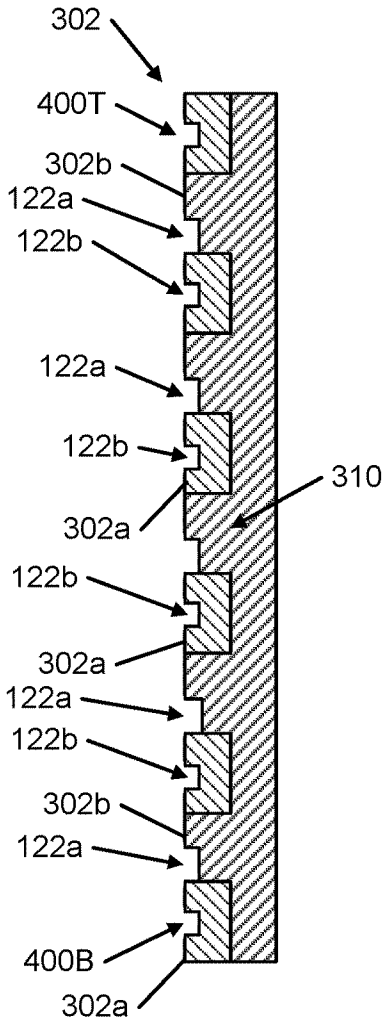

In the example structures 100 shown in FIGS. 1A-2J, the grooves 122*b* and recesses 204 are formed directly in the ball striking face 102 of a club head 100. Other options are possible. For example, as shown in FIGS. 3A-3C, a portion of the golf club head 300's ball striking face may be formed as an insert 302 that is fit into and engaged into a recess 304 defined in the front surface 306*a* of the club head body 306 (e.g., engaged by adhesives or cements, fusing techniques, mechanical connectors, etc.). In this example structure 300, the insert 302 is formed of a front member 302*a*, e.g., a front plate, optionally made of a metal or polymer material, that is engaged with a rear member 302*b*, e.g., a rear plate, optionally made of a polymer material that is not as hard as the material of the front member 302*a* (e.g., engaged together by adhesives or cements, fusing techniques, mechanical connectors, etc.). The front member 302*a* may be formed to include recesses 310 defined therein (e.g., elongated channels as through holes), and the material of the rear member 302*b* may be exposed at the front surface 306*a* of the club head body through these recesses 310. If desired, the rear member 302*b* may be formed to include projections that extend into the recess 310, or the rear member 302*b* may be made from sufficiently pliable or flowable material (at least at some stage in the production process) such that pressure (e.g., pressing members 302*a* and 302*b* together) will force material of the rear member 302*b* to flow into and at least partially fill the recesses 310. Grooves 122*a* and/or 122*b*, e.g., having any of the structures, characteristics, and/or features of the similar structures described above, may be formed in the insert 302 at any appropriate time, e.g., as shown in FIGS. 3A-3C.

As some more specific examples, if desired, the front member 302*a* may be made from a relatively hard material, e.g., a metal or polymer material, such as a SURLYN® 8150 material (an ionomer of ethylene acid copolymer available from E.I. DuPont de Nemours and Company, Inc.), having a hardness of at least 55 Shore D (and in some examples, at least 60 Shore D, within a range of 55 to 85 Shore D, or even within a range of 58 to 75 Shore D (e.g., about 65 Shore D)) and/or having a flexural modulus of at least 50 kpsi (and in some examples, between 50-95 kpsi or even between 60-82 kpsi (e.g., about 71 kpsi)). Additionally or alternatively, if desired, the rear member 302*b* may be made from a relatively soft material, e.g., a polymer material, such as a HPF-1000 material (an ionomer of ethylene acid acrylate terpolymer available from E.I. DuPont de Nemours and Company, Inc.), having a hardness of less than 65 Shore D (and in some examples, less than 58 Shore D, within a range of 35 to 65 Shore D, or even within a range of 40 to 60 Shore D) (e.g., about 51 Shore D)) and/or having a flexural modulus of less than 50 kpsi (and in some examples, less than 40 kpsi, within a range of 20 to 50 kpsi, or even within a range of 25 to 40 kpsi) (e.g., about 31 kpsi)). Additionally or alternatively, in some examples of this invention, the Shore D hardness differential between the relatively hard member (e.g., 302*a*) and the relative soft member (e.g., 302*b*) will be at least 8 Shore D points, and in some examples, at least 10 Shore D points or even at least 12 Shore D points.

Figure 3D:
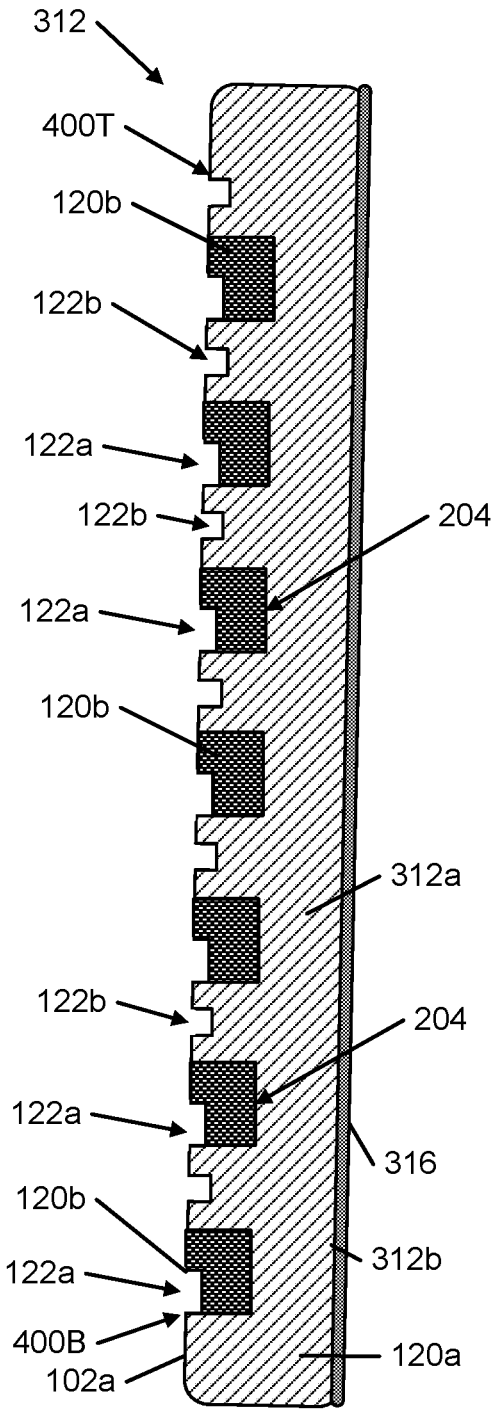

FIG. 3D shows an alternative insert structure 312, e.g., having a cross-sectional structure similar to the integrally formed face 102 of FIGS. 1A-2J, except this insert structure 312 is built to fit into the recess 304 of club 300 (FIGS. 3A and 3B). More specifically, this insert 312 includes a base member 312*a* made from a first material 120*a* (e.g., a metal or polymer material). Relatively deep recesses 204 and/or the second plurality of grooves 122*b* are formed in the ball striking surface 102*a* of base member 312*a*. The relatively deep recesses 204 are at least partially filled with the second material 120*b* (e.g., a polymeric material softer than material 120*a*), which may be secured in the recesses 204 in any desired manner (including the various manners described above). The first plurality of grooves 122*a* may be formed at the junction areas of the first material 120*a* and the second material 120*b*, e.g., in the manners described above. The grooves 122*a* and/or 122*b* may have any of the various features described above with respect to the grooves 122*a*/122*b* in FIGS. 1A-2J. If desired, the back surface 312*b* of base member 312*a* of the insert 312 may include a layer of polymer or resilient material 316, e.g., to provide a somewhat softer feel when balls are hit and/or a layer of adhesive (e.g., double-sided tape) to secure the insert 312 in recess 304.

Alternatively, if desired, the locations of materials 120*a* and 120*b* can be reversed in the structures illustrated in FIGS. 1A-2J and 3D (and the above-described variations thereof) such that the harder material is located within the deep recesses 204 and the softer material forms the portion of the club head body 102 (FIGS. 1A-2J) or the base member 312*a* of the insert 312 (FIG. 3D).

The insert 302, 312 outer edges may form any desired shape without departing from this invention (and fit into a correspondingly shaped recess in the club head face 306), including, for example, a triangular shape, rectangular shape, trapezoidal shape, parallelogram shape, pentagon shape, hexagon shape etc., optionally polygon shapes (and optionally with rounded corners). The insert 302 and recess shown in FIGS. 3A-3C have a generally hexagonal shape with the top edge longer than the bottom edge.

FIGS. 2G, 3B, and 3D illustrate additional features that may be included in golf club heads in accordance with at least some examples of this invention. More specifically, as show in these figures, the golf club heads 100, 300 include a golf club head body having a ball striking face, a top, and a bottom. In these structures, the exposed ball striking surfaces of the club heads include: (a) an overall top-most groove edge (e.g., 400T in FIGS. 2G, 3B, and 3D), (b) an overall bottom-most groove edge (e.g., 400B in FIGS. 2G, 3B, and 3D), and (c) a plurality of grooves (e.g., 122*a* and/or 122*b*) defined in the ball striking face between the top-most groove edge 400T and the bottom-most groove edge 400B. In at least some example structures in accordance with this invention: (A) a first subset of the plurality of grooves (e.g., grooves 122*a*) will include a plurality of grooves 122*a* having a first edge formed from a first material (e.g., material 120*a*) of the ball striking face and a second edge opposite the first edge formed from a second material (e.g., material 120*b*) of the ball striking face, wherein the first material is different from the second material; and (B) a second subset of the plurality of grooves (e.g., grooves 122*b*) will include a plurality of grooves 122*b* having a first edge formed from the first material (e.g., material 120*a*) and a second edge opposite the first edge also formed from the first material (material 120*a*).

In such structures, along the top-to-bottom center line C/L of the ball striking face from the top-most groove edge 400T to the bottom-most groove edge 400B, the exposed ball striking surface will include: (a) at least 25% of the first material 120*a* (e.g., the harder material (e.g., metal or polymer)); (b) at least 20% of the second material 120*b* (e.g., the softer material (e.g., polymer)); and (c) at least 35% open space corresponding to locations of the plurality of grooves 122*a*, 122*b*. As another example, along the top-to-bottom center line C/L of the ball striking face from the top-most groove edge 400T to the bottom-most groove edge 400B, the exposed ball striking surface will include: (a) at least 28% of the first material 120*a* (e.g., the harder material (e.g., metal or polymer)); (b) at least 20% of the second material 120*b* (e.g., the softer material (e.g., polymer)); and (c) at least 38% open space corresponding to locations of the plurality of grooves 122*a*, 122*b*. As yet another example, along the top-to-bottom center line C/L of the ball striking face from the top-most groove edge 400T to the bottom-most groove edge 400B, the exposed ball striking surface will include: (a) at least 30% of the first material 120*a* (e.g., the harder material (e.g., metal or polymer)); (b) at least 22% of the second material 120*b* (e.g., the softer material (e.g., polymer)); and (c) at least 40% open space corresponding to locations of the plurality of grooves 122*a*, 122*b*.

While the examples of FIGS. 1A-3D show the grooves 122*a* with the harder edge (e.g., defined by the metal or harder polymer material 120*a*) located below the softer edge (e.g., defined by the softer polymer material), the inverse arrangement is possible, if desired, on one or more of the plurality of grooves 122*a* without departing from this invention (e.g., with the softer edge of one or more grooves 122*a* located below the harder edge of that same groove 122*a*). That inverse arrangement may provide a somewhat different sound, feel, and/or propulsion characteristics.

The above-described groove arrangements and combinations can be used in any desired types of golf club head structures without departing from this invention, including putter heads, iron heads, hybrid heads, wood-type golf club heads, etc. When used in putter heads, e.g., of the types illustrated in FIGS. 1A-3D, some advantageous features can be realized. More specifically, the presence of the relatively soft polymer fill material (e.g., material 120*b*, such as a thermoplastic polyurethane) can somewhat grip the ball and/or a relatively soft golf ball cover material. Also, providing the sharp groove edges in the polymer material 120*b* and/or the metal material 120*a* at grooves 122*a* and/or 122*b* can help grip the ball. These gripping features can allow a manufacturer to provide a relatively low loft angle on the putter face (e.g., about 2° or 3° as compared to 4° for many conventional putters).

Figure 4A:
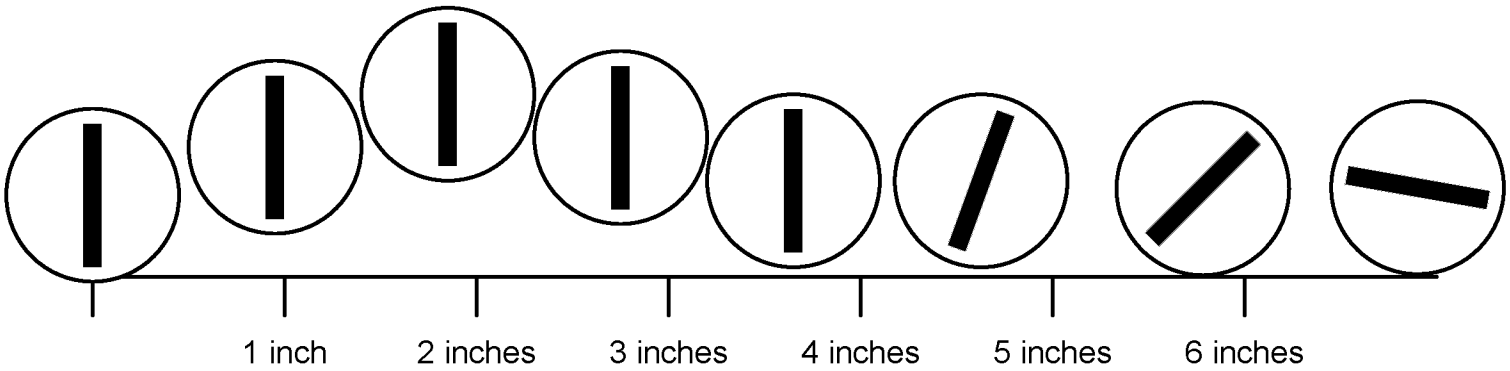
FIG. 4A (Prior Art)
FIGS. 4A and 4B schematically illustrate example trajectories of a ball during a putt when the ball is putted with a conventional putter and with a putter in accordance with at least some examples of this invention, respectively.

In use, as a golf ball sits on the green, its weight forces it down somewhat into the grass. When putting, the putter head must first somewhat "pop" the ball out of this settled condition. Therefore, putter faces generally have some loft to help launch the ball at an upward angle. This upward launch angle, however, propels the ball upward (in some instances the ball may actually leave the ground), which causes it to fly or skid across the green before it begins a true roll, as shown in FIG. 4A. This bounce or skid can present some inconsistency in speed, because the ball does not always "fly" or "skid" the same amount, and the bounce can end up taking inconsistent amounts of energy off the ball during the transition between the flying and skidding mode to the rolling mode (e.g., depending on the contours of the green). In some instances, the loft of the putter head can actually produce a small amount of backspin on the ball during a putt.

Putter structures in accordance with at least some examples of this invention, however, may provide quicker and truer roll as compared to conventional putters. As noted above, because of the relatively soft polymer materials and the sharp edges in the polymer and metal (e.g., from the edges of grooves 122*a*, 122*b*), the putter face 102*a* may tend to "grip" the ball a bit better during a putt. This helps "pop" the ball out of its settled condition somewhat more easily and tends to better induce top spin on the ball (which tends to keep the ball on the ground and get it rolling somewhat more quickly), particularly if the ball is struck on an upswing phase of a stroke. Also, these features may allow the putter head to have a less lofted face angle (e.g., 2° to 3° vs. a conventional 4°). Thus, the ball does not tend to launch as high out of the settled condition, causing it to more quickly contact the ground once out of the settled position, and the induced top spin gets it rolling more quickly. A schematic diagram of an example trajectory of the ball using an example putter head according to this invention is shown in FIG. 4B.

Figure 4B:
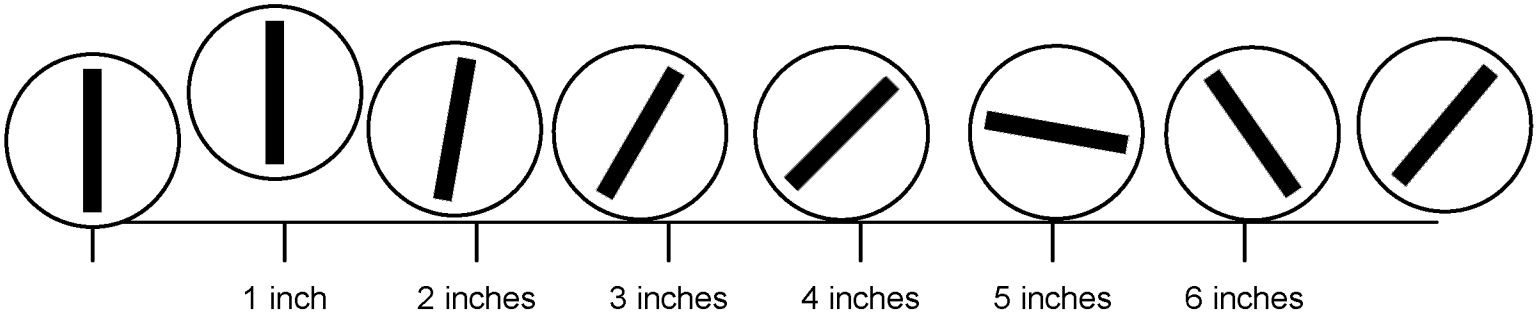

As shown in FIGS. 4A and 4B, putter heads in accordance with some examples of this invention may get the ball rolling much earlier during the course of a putt. By getting the ball rolling earlier, with less bounce and skid (and the uncertainty introduced into the putt due to these undesired factors), putter heads in accordance with some examples of this invention tend to provide more reliable and repeatable putting distances, putted ball speeds, and distance control.

Moreover, the combination of metal (when metal is used) and polymer on the face of the putter head provides a nice, soft and consistent feel (optionally controllable by selecting the hardnesses of the various parts) while still providing a more conventional "metal-on-ball" sound (or "click") of conventional putters. This sound feature also is an important part of the "feel" for many golfers, and maintaining this metallic sound helps prevent a more "dead" sound of putting a ball against a full polymer material on a putter face (e.g., as provided in many conventional putters that simply have a polymer insert).

Any desired polymeric material may be used for material 120*b* (and optionally, 120*a*) without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc. Additionally or alternatively, recycled materials, such as recycled polymer materials, may be used in any of the above-described arrangements without departing from the invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a golf club head body including a ball striking face, a top, a bottom, a heel edge, and a toe edge; wherein the ball striking face comprises a first material;

a plurality of recesses disposed on the ball striking face between the top and the bottom, each of the plurality of recesses extending between the heel edge and the toe edge; wherein the plurality of recesses are filled with a fill material;

wherein the ball striking face comprises a top-to-bottom center line; the ball striking face includes:

(a) a top-most groove edge, (b) a bottom-most groove edge, and (c) a plurality of grooves defined the ball striking face between the top-most groove edge and the bottom-most groove edge, a plurality of first grooves disposed on the ball striking face between the top and the bottom, each of the plurality of first grooves extending between the heel edge and the toe edge;

a plurality of second grooves disposed partially within the fill material, each of the plurality of second grooves extending between the heel edge and the toe edge;

wherein the plurality of recesses extend deeper into the club head, measured in a direction perpendicular to the ball striking face, than the plurality of first grooves;

wherein the plurality of first grooves extend deeper into the club head, measured in a direction perpendicular to the ball striking face, than the plurality of second grooves; and wherein at least 25% of the top-to-bottom center line of the ball striking face from the top-most groove edge to the bottom-most groove edge includes the first material, at least 20% of the top-to-bottom center line of the ball striking face from the top-most groove edge to the bottom-most groove edge includes the fill material, and at least 35% of the top-to-bottom center line of the ball striking face from the top-most groove edge to the bottom-most groove edge includes open space.

2. The golf club head of claim 1, wherein each of the plurality of first grooves comprises a first horizontal edge, and a second horizontal edge opposite the first horizontal edge, wherein the first and second horizontal edge of each first groove constitutes the first material.

3. The golf club head of claim 1, wherein the plurality of second grooves comprises a first horizontal edge, and a second edge horizontal edge opposite the first horizontal edge, wherein the first horizontal edge of each second groove constitutes the fill material, and the second horizontal edge of each second groove constitutes the first material.

4. The golf club head of claim 1, wherein the plurality of second grooves comprises a first horizontal edge, and a second edge horizontal edge opposite the first horizontal edge, wherein the first horizontal edge and the second horizontal edge of each second groove constitutes the fill material.

5. The golf club head of claim 1, wherein the ball striking face comprises a plurality of land areas positioned between the grooves.

6. The golf club head of claim 5, wherein the fill material extends flush with the ball striking face to form a portion of the plurality of land areas.

7. The golf club head of claim 1, wherein the fill material further comprises a first fill material filled in at least one recess, and a second fill material filled in at least one recess, wherein the first fill material has a different hardness than the second fill material.

8. The golf club head of claim 1, wherein the first material is a metal material, and the fill material is a polymer material.

9. The golf club head of claim 1, wherein a length, measured in a direction from the heel edge to the toe edge, of either the plurality of first grooves or the plurality of second grooves varies in a top-to-bottom direction.

10. The golf club head of claim 1, wherein the first plurality of grooves comprises a first height dimension measured in a top-to-bottom direction, wherein the second plurality of grooves comprises a second height dimension measured in a top-to-bottom direction, wherein the first height dimension is greater than the second height dimension at a top-to-bottom centerline of the ball striking face.

11. A golf club head comprising:

a golf club head body including a ball striking face, a top, a bottom, a heel edge, and a toe edge; wherein the ball striking face comprises a first material;

wherein the ball striking face comprises a top-to-bottom center line; the ball striking face includes:

(d) a top-most groove edge, (e) a bottom-most groove edge, and (f) a plurality of grooves defined the ball striking face between the top-most groove edge and the bottom-most groove edge, a plurality of recesses disposed on the ball striking face between the top and the bottom, each of the plurality of recesses extending between the heel edge and the toe edge; wherein the plurality of recesses are filled with a fill material;

a plurality of first grooves disposed on the ball striking face between the top and the bottom, each of the plurality of first grooves extending between the heel edge and the toe edge;

a plurality of second grooves disposed within fill material, each of the plurality of second grooves extending between the heel edge and the toe edge;

wherein the plurality of recesses extend deeper into the club head, measured in a direction perpendicular to the ball striking face, than the plurality of first grooves;

wherein the plurality of first grooves extend deeper into the club head, measured in a direction perpendicular to the ball striking face, than the plurality of second grooves;

wherein a depth of the plurality of first grooves or the plurality of second grooves varies between the heel edge and the toe edge; and wherein at least 25% of the top-to-bottom center line of the ball striking face from the top-most groove edge to the bottom-most groove edge includes the first material, at least 20% of the top-to-bottom center line of the ball striking face from the top-most groove edge to the bottom-most groove edge includes the fill material, and at least 35% of the top-to-bottom center line of the ball striking face from the top-most groove edge to the bottom-most groove edge includes open space.

12. The golf club head of claim 11, wherein each of the plurality of first grooves comprises a first horizontal edge, and a second horizontal edge opposite the first horizontal edge, wherein the first and second horizontal edge of each first groove constitutes the first material.

13. The golf club head of claim 11, wherein the plurality of second grooves comprises a first horizontal edge, and a second edge horizontal edge opposite the first horizontal edge, wherein the first horizontal edge of each second groove constitutes the fill material, and the second horizontal edge of each second groove constitutes the first material.

14. The golf club head of claim 11, wherein the plurality of second grooves comprises a first horizontal edge, and a second edge horizontal edge opposite the first horizontal edge, wherein the first horizontal edge and the second horizontal edge of each second groove constitutes the fill material.

15. The golf club head of claim 11, wherein the ball striking face comprises a plurality of land areas positioned between the grooves.

16. The golf club head of claim 15, wherein the fill material extends flush with the ball striking face to form a portion of the plurality of land areas.

17. The golf club head of claim 11, wherein the fill material further comprises a first fill material filled in at least one recess, and a second fill material filled in at least one recess, wherein the first fill material has a different hardness than the second fill material.

18. The golf club head of claim 11, wherein the first material is a metal material, and the fill material is a polymer material.

19. The golf club head of claim 11, wherein a length, measured in a direction from the heel edge to the toe edge, of either the plurality of first grooves or the plurality of second grooves varies in a top-to-bottom direction.

20. The golf club head of claim 11, wherein the first plurality of grooves comprises a first height dimension measured in a top-to-bottom direction, wherein the second plurality of grooves comprises a second height dimension measured in a top-to-bottom direction, wherein the first height dimension is greater than the second height dimension at a top-to-bottom centerline of the ball striking face.

* * * * *